US009607505B2

(12) United States Patent
Rothkopf et al.

(10) Patent No.: US 9,607,505 B2
(45) Date of Patent: Mar. 28, 2017

(54) CLOSED LOOP UNIVERSAL REMOTE CONTROL

(75) Inventors: Fletcher Rothkopf, Los Altos, CA (US); Stephen Brian Lynch, Portola Valley, CA (US)

(73) Assignee: Apple Inc., Cupertino, CA (US)

( * ) Notice: Subject to any disclaimer, the term of this patent is extended or adjusted under 35 U.S.C. 154(b) by 599 days.

(21) Appl. No.: 12/887,816

(22) Filed: Sep. 22, 2010

(65) Prior Publication Data

US 2012/0068833 A1 Mar. 22, 2012

(51) Int. Cl.
*G08C 19/18* (2006.01)
*G08C 17/02* (2006.01)

(52) U.S. Cl.
CPC ..... *G08C 17/02* (2013.01); *G08C 2201/51* (2013.01); *G08C 2201/92* (2013.01)

(58) Field of Classification Search
CPC ..... G05B 15/02; H04N 5/4403; H04N 21/42204; H04N 21/44008; H04N 21/4334; H04N 21/4223; G06F 3/0238; G06K 9/00; G08C 23/04
USPC ..... 340/12.22, 12.24, 12.27, 12.4, 12.5, 340/12.51, 12.52, 12.53, 12.55, 825.69; 398/106, 107, 108, 109, 112; 436/64; 700/266
See application file for complete search history.

(56) References Cited

U.S. PATENT DOCUMENTS 5,583,560 A 12/1996 Florin et al.
5,652,849 A 7/1997 Conway et al.
5,726,645 A 3/1998 Kamon et al.
5,797,085 A * 8/1998 Beuk et al. ..... 455/88
6,396,523 B1 5/2002 Segal et al.
6,633,281 B2 10/2003 Lin et al.
(Continued)

FOREIGN PATENT DOCUMENTS

FR 2801402 5/2001
GB 2433211 6/2007
(Continued)

OTHER PUBLICATIONS

Author Unknown, "RedEye mini Plug-in Universal Remote Adapter for iPhone, iPod touch and iPad," Amazon.com, 4 pages, date unknown.

(Continued)

*Primary Examiner* — Wayne Young
*Assistant Examiner* — Mancil Littlejohn, Jr.
(74) *Attorney, Agent, or Firm* — Brownstein Hyatt Farber Schreck, LLP

(57) ABSTRACT

An electronic device configured for closed loop remote control functionality and related methods are disclosed herein. In particular, in one embodiment, an electronic device configured for closed loop remote control functionality is provided. The device includes a processor and a transmitter configured to wirelessly transmit instructions to a remotely controlled device. Additionally, the device includes an input device configured to allow a user to provide input to the electronic device related to remote control and one or more sensors configured to obtain information related to a state of the remotely controlled device. The processor is configured to use the information obtained by the one or more sensors to determine the state of the remote controlled devices upon receiving the input from a user to transmit instructions.

20 Claims, 8 Drawing Sheets

(56) References Cited

U.S. PATENT DOCUMENTS

| | | | | |
|---|---|---|---|---|
| 6,784,918 | B1 * | 8/2004 | Ritchie | G06F 3/002 348/61 |
| 6,794,992 | B1 | 9/2004 | Rogers | |
| 6,806,715 | B1 * | 10/2004 | Domadia | G01R 31/2635 324/414 |
| 6,914,551 | B2 | 7/2005 | Vidal | |
| 7,167,083 | B2 | 1/2007 | Giles | |
| 7,230,563 | B2 | 6/2007 | Vidal | |
| 7,274,303 | B2 | 9/2007 | Dresti et al. | |
| 7,443,386 | B2 | 10/2008 | Gao et al. | |
| 7,584,429 | B2 | 9/2009 | Fabritius | |
| 7,634,263 | B2 | 12/2009 | Louch et al. | |
| 7,710,456 | B2 * | 5/2010 | Koshiba | 348/207.1 |
| 7,760,190 | B2 | 7/2010 | Yeh | |
| 7,998,741 | B2 * | 8/2011 | Nishikiori et al. | 436/43 |
| 8,054,294 | B2 | 11/2011 | Sakai et al. | |
| 8,271,908 | B2 | 9/2012 | Li et al. | |
| 8,401,792 | B2 | 3/2013 | Yeh et al. | |
| 8,640,046 | B1 | 1/2014 | Jania | |
| 2006/0026536 | A1 | 2/2006 | Hotelling et al. | |
| 2006/0192855 | A1 * | 8/2006 | Harris et al. | 348/162 |
| 2007/0050054 | A1 | 3/2007 | Sambandam Guruparan et al. | |
| 2007/0080845 | A1 * | 4/2007 | Amand | 341/176 |
| 2007/0124772 | A1 | 5/2007 | Bennett et al. | |
| 2007/0210932 | A1 * | 9/2007 | Koshiba | G08C 23/04 340/12.22 |
| 2008/0120541 | A1 | 5/2008 | Cheng | |
| 2009/0128361 | A1 * | 5/2009 | Lee et al. | 340/825.69 |
| 2009/0153288 | A1 | 6/2009 | Hope et al. | |
| 2009/0327948 | A1 | 12/2009 | Penttinen et al. | |
| 2010/0053468 | A1 | 3/2010 | Havrill | |
| 2010/0081375 | A1 | 4/2010 | Rosenblatt et al. | |
| 2011/0018817 | A1 | 1/2011 | Kryze et al. | |
| 2012/0068857 | A1 | 3/2012 | Rothkopf et al. | |
| 2012/0075082 | A1 | 3/2012 | Rothkopf et al. | |
| 2012/0124469 | A1 | 5/2012 | Nakajima et al. | |
| 2012/0290287 | A1 | 11/2012 | Fux et al. | |
| 2013/0232437 | A1 | 9/2013 | Kim | |
| 2014/0191977 | A1 | 7/2014 | Feng | |
| 2015/0106764 | A1 | 4/2015 | Chang | |

FOREIGN PATENT DOCUMENTS

| | | |
|---|---|---|
| WO | WO01/69567 | 9/2001 |
| WO | WO2010/058376 | 5/2010 |

OTHER PUBLICATIONS

Author Unknown, "Re iPhone Universal Remote Control—Infrared Remote Control Accessory for iPhone and iPod touch," http://www.amazon.com/iPhone-Universal-Remote-Control-Accessory/dp/tech-data/B0038Z4 . . . , 2 pages, at least as early as Jul. 15, 2010.

IBM, "Additional Functionality Added to Cell Phone via "Learning" Function Button," www.ip.com, 2 pages, Feb. 21, 2007.

Tran et al., "Universal Programmable Remote Control/Telephone," www.ip.com, 2 pages, May 1, 1992.

Kelly et al., "Designing RF Remote Controls for DTV Products," [Online], Digital TV Design Line, retrieved on Nov. 7, 2007, URL: www.digitaltvdesignline.com/showArticle.jhtml?printableArticle=true&articleId=202100019, 3 pages.

"Phillips and Samsung spearhead new CEA-2014 (Web4CE) HTML-based remote user interfaces for UPnP home-networked applications and internet services," [Online], HiddenWires, retrieved on Nov. 7, 2007, URL: hiddenwires.co.uk/resourcenews2006/news20060223-12.html, 1 page.

"UPnP Media Controller" [Online], Cidero, retrieved on Dec. 12, 2007, URL: www.cidero.com/mediacontroller.html, 7 pages.

* cited by examiner

CLOSED LOOP UNIVERSAL REMOTE CONTROL

BACKGROUND OF THE INVENTION

Field of Invention

The present disclosure relates to a remote control device and, more particularly, to closed loop functionality for the universal remote control device.

Background

Some remote controls may be configurable to control multiple different electronic devices. Commonly, such remote controls are referred to as "universal remote controls" and they consolidate the control of electronic devices that may be used in a common area and/or for a common purpose. Thus, instead of using multiple controllers (e.g., one controller per device) a single controller may be used. A common example is a remote control for controlling both a television and a cable box rather than using two "native" remote controls.

Advanced universal remote controls may be capable of controlling dozens of devices, including audio/video equipment and home automation systems (e.g., lighting, door locks, and the like). Generally, infrared remotes use simple macros to control multiple devices. For example, a user may press a button on the universal remote for "Watch cable TV," and the remote issues signals to turn on the cable box, turn on the TV and then set the TV to display the input from the cable box. In some instances, however, control signals are not received by one or more of the devices that are being controlled. Thus, the devices may not arrive in a desired state, leaving a user to figure out what action to take to obtain the desired state. Typically, because the remote control is typically a one-way, or open-loop device, the remote control device has no indication that the command was not properly acted on and takes no corrective action. This can be a frustrating ordeal when the user must navigate menus to find a proper button to actuate a desired command. In some cases, the proper button may be used infrequently and/or the user may not be familiar with it.

SUMMARY OF THE INVENTION

A remote control device that is configurable to gather state information from a controlled component. In some embodiments, the remote control device may have one or more sensors to facilitate the state determination. For example, the remote control may have one or more cameras, microphones and/or other sensors. The sensors may be configured to operate upon actuation of the remote control device to determine if signals transmitted by the remote control were received and a desired result was achieved.

In some embodiments, a status indicator light may be evaluated to determine a status of the controlled device. For example, the remote control may analyze a captured image and determine the presence of colors associated with the status light indicators of the devices. If the status light is green, for example, the remote control may determine that the device is on, whereas if it is red, the remote control may determine that the device is off.

Moreover, in some embodiments, the remote control may include a camera that is configured to capture an image of controlled devices. The image is then processed to find a state of the device. For example, in some embodiments, the image may be processed to determine shapes and/or characters on a television screen. The shapes and characters may be used to determine that the television is displaying content from a particular source.

Additionally, in some embodiments, the remote control may include microphones and be configured to determine a state of a controlled device based on sound from one or more of the controlled devices. For example, the remote control may determine a sound level and/or if the sound level changes. Additionally, in some embodiments, the presence or absence of sound may be used to determine if a controlled device is on or off.

Furthermore, in some embodiments, the remote control may be configured to issue command or not issue commands upon receiving user input after determining the status of a controlled device. That is, if a remote control receives an input from the user requesting to turn on the television but the television is already on, the remote control will determine that the television is on and not issue the command.

While multiple embodiments are disclosed, still other embodiments of the present invention will become apparent to those skilled in the art from the following Detailed Description. As will be realized, the embodiments are capable of modifications in various aspects, all without departing from the spirit and scope of the embodiments. Accordingly, the drawings and detailed description are to be regarded as illustrative in nature and not restrictive.

DETAILED DESCRIPTION

Figure 1:
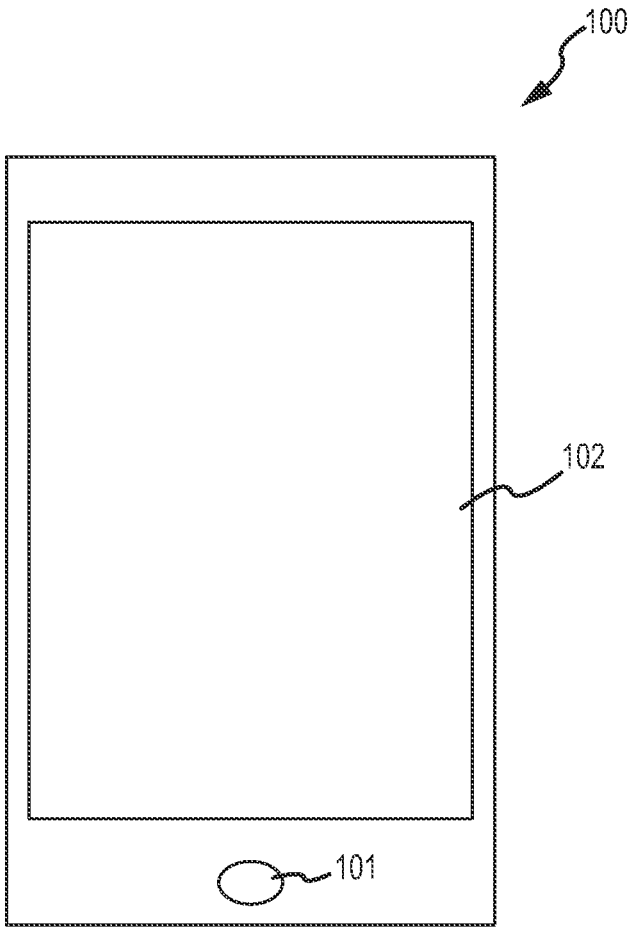
FIG. 1 illustrates an electronic device that may be used as a remote control.

The present disclosure relates to a closed-loop remote control system. In particular systems and techniques are disclosed that relate to using a control device to determine a state of devices which are being controlled by the control device. In some embodiments, the control device may be a dedicated universal remote control. In other embodiments, the control device may take the form of a portable media player, a smartphone, a personal digital assistant, a cellphone, or other device that has been configured and/or programmed to function as a remote control. For example, in some embodiments, a portable media player may be configured with infrared (IR) emitting capabilities so that it may function as a remote control.

The control device may be configured to determine a state of controlled devices and/or whether a change of state has occurred upon transmission of a control signal. In particular, in some embodiments, the control device may have a light sensitive device and may be capable of determining colors emitted by a controlled device. In other embodiments, the control device may be configured with a light sensor that can detect when a television is on or off based on the amount of light that is emitted from the television.

In other embodiments, the control device may be configured to capture and analyze images of the controlled device(s) to determine a current state or if the state of the controlled devices has changed. For example, an image or series of images may be captured of a television screen to determine if volume or channel has been changed by evaluating on screen indicators. In some embodiments, the image(s) may be analyzed to determine if a number or channel identifier has been displayed on the screen indicating that the channel has changed. Further, in some embodiments, the number of channel identifier may be used by the control device to know if the device is in a desired state. In other embodiments, the control device may analyze the image(s) to determine whether a volume scale or number has been displayed indicating that the volume has changed. Additionally, in some embodiments, a microphone and sounds received by the microphone may be used to determine the volume, a volume change, if a device is on, or if a channel or input to a controlled device has changed.

In other embodiments, the control device may be configured to execute commands to achieve a user's desired result rather than simply issuing commands. For example, upon receiving user input to issue a command, the control device may be configured to determine a current state of the device being controlled to determine if a command should be issued. There are many possible scenarios where this may be useful. In particular, for example, in the case where a user desires to use a DVD player to view a movie and the television is already on, a user may enter a DVD mode on the controller that may automatically issue commands to turn on the DVD player, a surround sound system and the television. However, commonly, the "on" signal for a device may coincide with the "off" signal and if the television is already on it will toggle off when the subsequent "on" signal is received. Accordingly, the control device may determine the state of the television and consequently determine to not issue an "on" command to the television. Hence, the intent of the user is achieved.

Turning now to the drawings and referring initially to FIG. 1, an example control device 100 is illustrated. Generally, the control device 100 may be any electronic device configured to control other electronic devices. For example, in some embodiments, the electronic device 100 may take the form of a smartphone configured with IR transmission capabilities. Typically, smartphones may be configured to perform a number of different functions for a user including voice and data communication, media playback, and camera functionality. In other embodiments, the control device 100 may take the form of a dedicated universal remote control. That is, the device is primarily a remote control device not configured to perform other functions. As will be discussed below, in some embodiments, the control device may utilize a microphone, a camera, or a light detector to determine the state of controlled devices.

The control device 100 may include one or more user interfaces to allow a user to provide input to the device. For example, the control device 100 may include one or more buttons 101, a scroll wheel, a trigger, a mouse pad, a keyboard, and/or other input devices. In some embodiments, as illustrated, the control device 100 may include a touch screen 102 to receive user input and/or display information to the user. The touch screen 102 may be configurable to display various different virtual buttons or virtual input modes to allow a user to issue commands to control other device.

Figure 2:
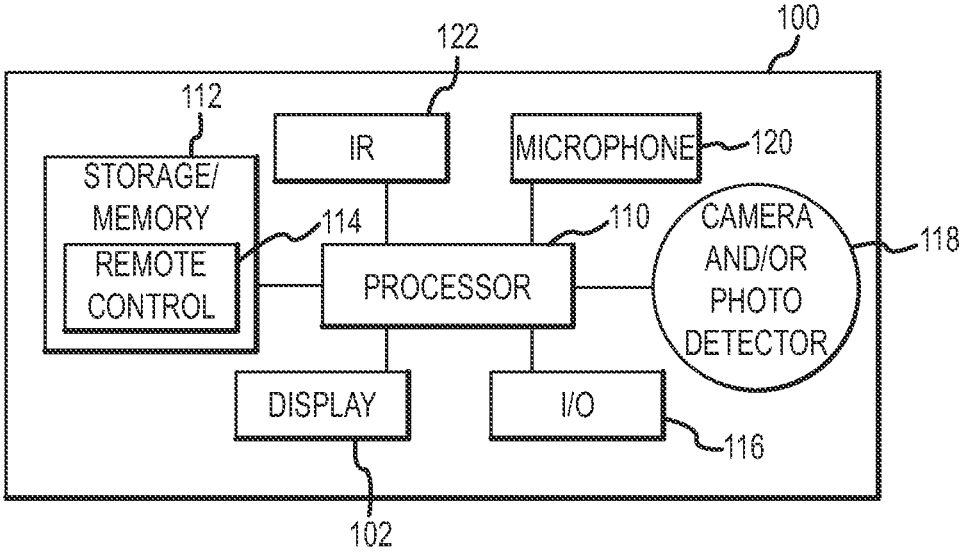
FIG. 2 is a block diagram of the electronic device of FIG. 1.

FIG. 2 is a block diagram illustration of the control device 100 showing various components. The control device 100 includes a processor 110 that may execute instructions and make determinations related to the state of controlled devices, for example. Additionally, the device 100 may include memory 112 coupled to the processor. The memory 112 may be configured to hold data, operating software and/or instructions for execution by the processor 110. For example, the memory 110 may include a remote control 114 computer program related to having the control device 100 function as a remote control.

The control device 100 may include one or more I/O ports 116 and other input devices to allow for collection of information related to the state of controlled devices. For example, the control device 100 may include a camera 118 and/or a microphone 120. Additionally, the device may include the display 102 and an IR device 122 for IR transmission capability. In some embodiments, the camera 118 and the IR device 122 may be mounted on a common face of the device so that as the control device 100 is aimed at controlled devices, it may capture images with the camera.

It should be appreciated that other modes of communicating commands may also be implemented in some embodiments. For example, in some embodiments, a radio frequency (RF) may be implemented with a corresponding protocol, such as Bluetooth®, or WiFi. As such, in some embodiments, the device 100 may include one or more RF antennas.

Figure 3:
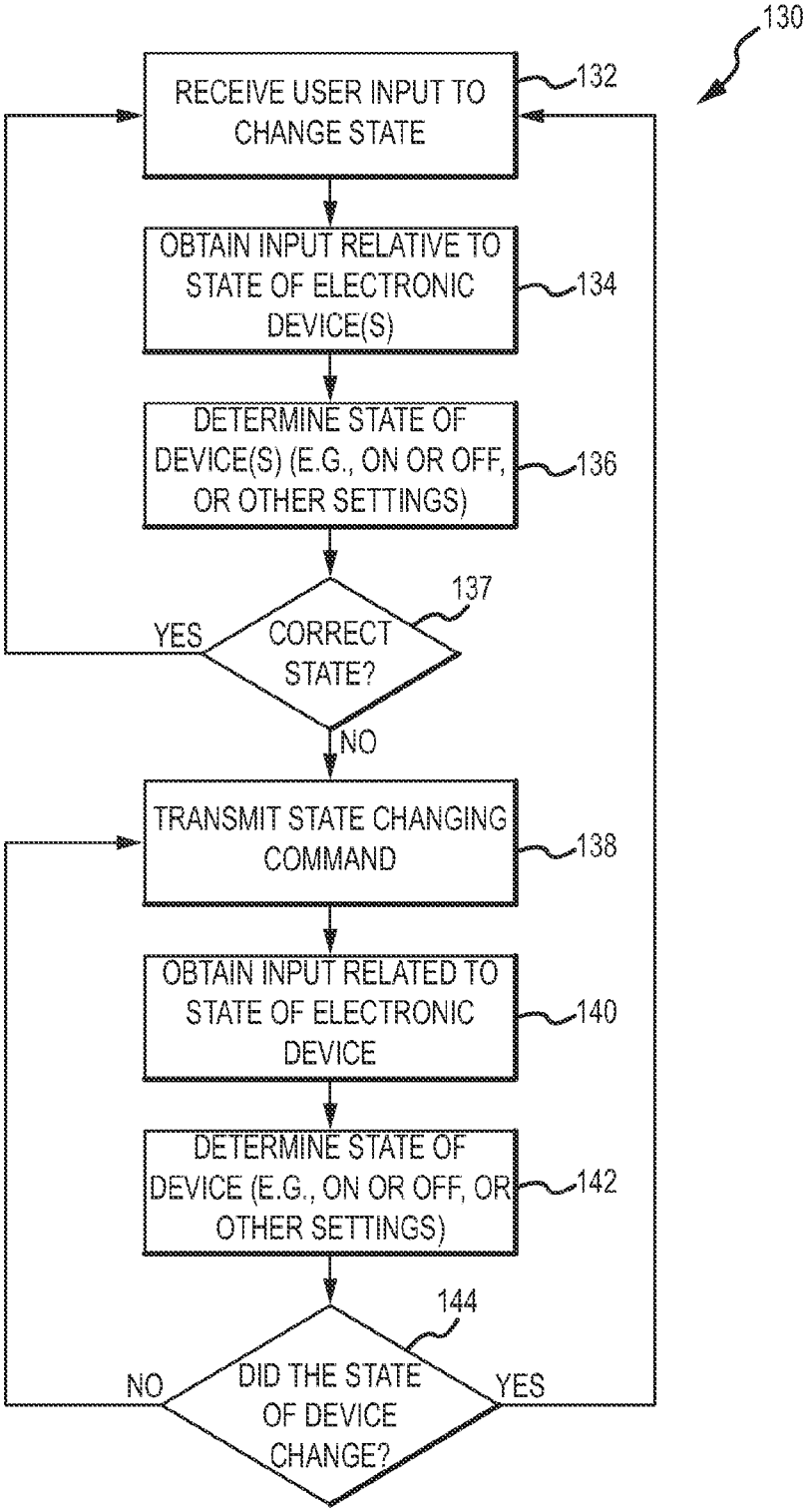
FIG. 3 is a flow chart illustrating a method of operating a control device configured to determine the state of devices that are being controlled

FIG. 3 is a flowchart illustrating an example technique 130 for operating the control device 100 as a closed loop remote control. The technique 130 may start with the control device 100 receiving user input to change the state of a controlled device (Block 132). The control device 130 may then obtain input related to the state of the controlled device (Block 134). For example, the control device 100 may capture an image using the camera 118 or record sound emitting from the controlled device using the microphone 120. From the obtained input, the control device may determine the state of the device (Block 136). For example, the control device 100 may determine if the controlled device is on or off, or other settings such as the volume of the controlled device. In some embodiments, the control device may determine if the controlled device is in a correct state (Block 137). If the controlled device is already in the correct state, the control device may await further input without taking any action.

If the controlled device is not in the desired state, the control device 100 may transmit a control signal to change the state of the device (Block 138) according to the command input by the user. The control device 100 again obtains sensor input related to the state of the controlled device (Block 140) and determines the state of the device (Block 142). Based on the current state of the controlled device, the control device 100 may determine if the state of the controlled device changed based on the transmitted control signal (Block 144). This may be achieved, for example, by comparing the current state with the previously determined state. Hence, in some embodiments, a relative change is determined. If the state of the controlled device remains unchanged, the control signal is again transmitted (Block 138) and the control device repeats the process. However, if the state changed, the control device 100 returns to block 132 and awaits for further user input.

As the control device 100 independently determines the state of the controlled devices based on information it has collected, the technique 130 may be implemented without modifying existing devices that are to be controlled by the control device 100. That is, the closed-loop remote control functionality does not rely upon the controlled devices providing information other than operating in their normal manner. Furthermore, to implement the technique in commonly available smartphones, generally, the smartphone will already have a camera and/or microphone to obtain the relevant information and configuration of the smartphone with an IR emitter likely would incur little cost.

It should be appreciated that the technique 130 may be implemented in different ways. In particular, the control device 100 may execute the steps of the technique in a different order. For example, the device 100 may determine the state of the controlled device before receiving any user input. Moreover, the input obtained from the controlled devices may vary in type and detail based on the capability and/or configuration of the control device 100.

Figure 4:
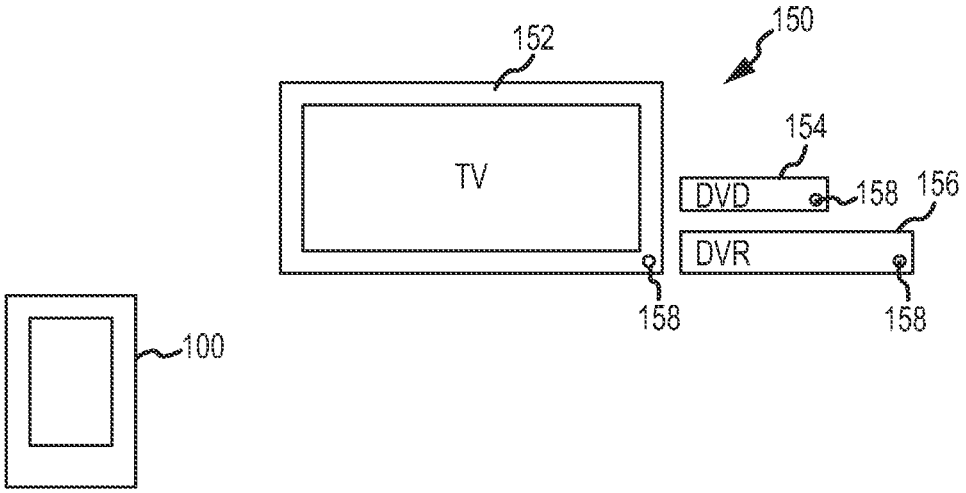
FIG. 4 illustrates an entertainment center with the electronic device of FIG. 1 recognizing the state of the devices in the entertainment center based on received sensor data such as colors.

FIG. 4 illustrates an example entertainment center 150 having a television 152, a digital video disc (DVD) player 154, and a digital video recorder (DVR) 156. One or more of the electronic devices of the entertainment center 150 may be a controlled device. As such, the control device 100 may be configured to determine the state of one or more of the devices in the entertainment center 150. In some embodiments, the control device 100 may capture an image of the entertainment center 150 and analyze the image to make the state determination. In some embodiments the control device 100 may be configured to determine an amount of light emitted from the television. In another embodiment, the control device 100 may be configured to determine if a status indicator light 158 on the devices is on. In some embodiments, the control device 100 may be configured to determine a level of the sound coming from the television 152 or if sound is coming from the television at all. In this case, a change in audio level can be used as an indication of whether a power on command or volume control command was acted upon.

Generally, the status indicator lights of the devices may be used to determine the status of the controlled devices. For example, some status indicator lights may display red when they are off and green or blue when they are on. Additionally, some status indicator lights may blink or flash when processing, when turning off or on, and/or when stalled. As such, the state of a controlled device may be determined by evaluating the status indicator light. In some embodiments, the memory 112 may store information related to the location, color indicators, words, symbols, and so forth that may be displayed on a front panel of a controlled device and/or a display of a controlled device for on-screen indicators. The control device may compare sensor data against the information in memory to make decisions relative to the status and/or changed status of controlled devices. In some embodiments, the control device may be trained by a user to compile state information to be stored in the memory 112 as a state database. For example, a user may capture an image of a controlled device while it is off and while it is on and designate the on state image and the off state image for storage. Upon controlling the device the on and off state images may be referenced so that the device may determine the state of the controlled device. Thus, the control device may be configured to learn to recognize states of controlled devices. In other embodiments, the control device may be preprogrammed with information in the database or may retrieve information for the database from a computer or database located on a network to which the control device may connect.

Figure 5:
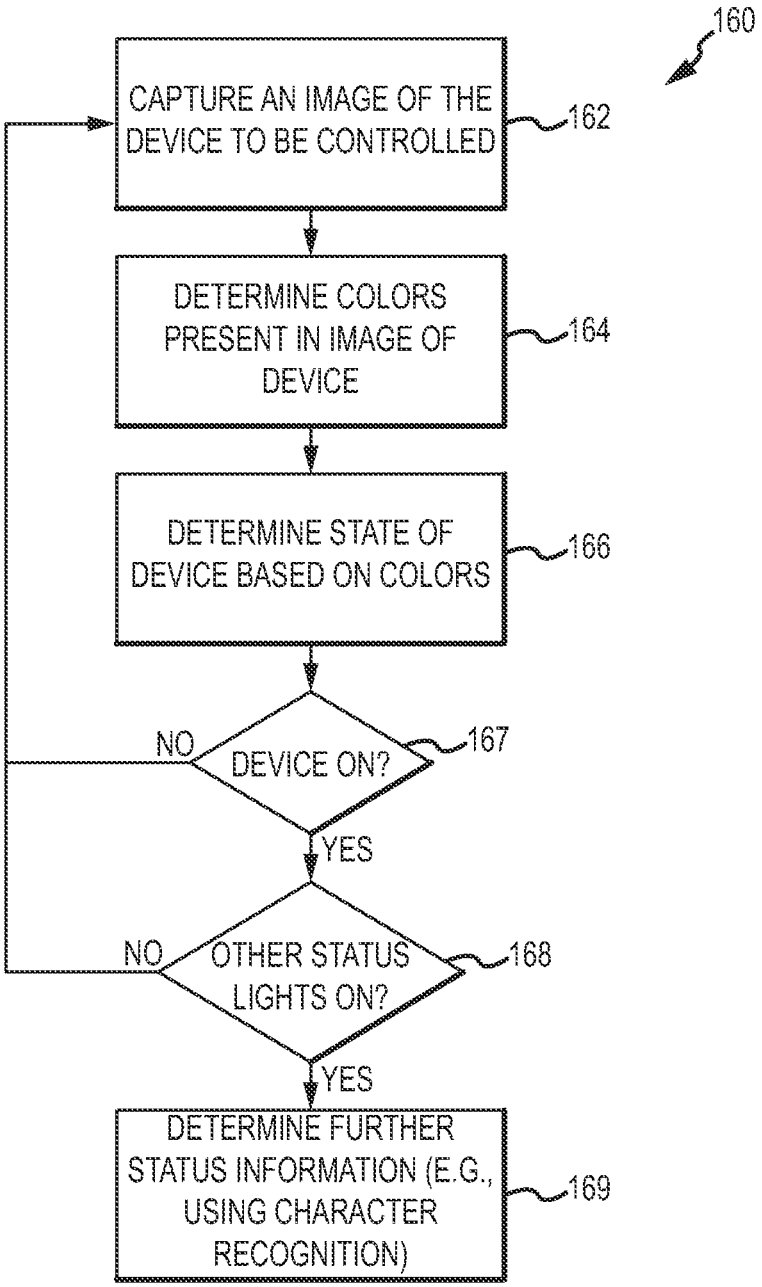
FIG. 5 is a flow chart illustrating an example technique for determining a status of a controlled device.

FIG. 5 is a flow chart illustrating an example method 160 for determining the state of a controlled device based on the status indicator lights. In particular, the method includes determining a color emanating from the status indicator light 158. The method 160 includes capturing an image of the controlled device (Block 162) and determining colors present in the image (Block 164). In particular, the control device may be configured to determine the color emanating from a particular location of the device (e.g., a location common for status indicator lights such as near a lower corner). The state of the device may then be determined based on determining the color of the status light (Block 166).

If the state of the device is determined to be on, further details may be sought through further evaluation of the captured image. For example, the image may be evaluated to determine if there are any numbers, words or letters displayed on the device and/or if there are other status lights that may communicate information, such as a recording light (e.g., a red light other than the on/off status light). As such, if it is determined that the device is on (Block 167), it may further be determined if there are other status lights on (Block 168). If there are no other status light or if the device is determined to not be on, the control device 100 may be configured to capture another image (Block 162) and/or to await further user input. However, if it is determined that other status lights are on, the other status lights may be evaluated to further determine the state of the controlled device (Block 169). For example, a channel number may be displayed on the DVR or the DVD player may indicate "PLAY", "STOP", "FF", "REV", and so forth. These indicators may be detected and deciphered using image processing with a character recognition program. Thus, the control device 100 may obtain specific state information for the devices.

Other state indicators may be used to determine a state of the device and/or if the state of the controlled device has changed. For example, many televisions display a volume indication when the volume is changed. Similarly, when a channel or input to the television is changed, the new channel or input may be displayed on the screen.

Figure 6:
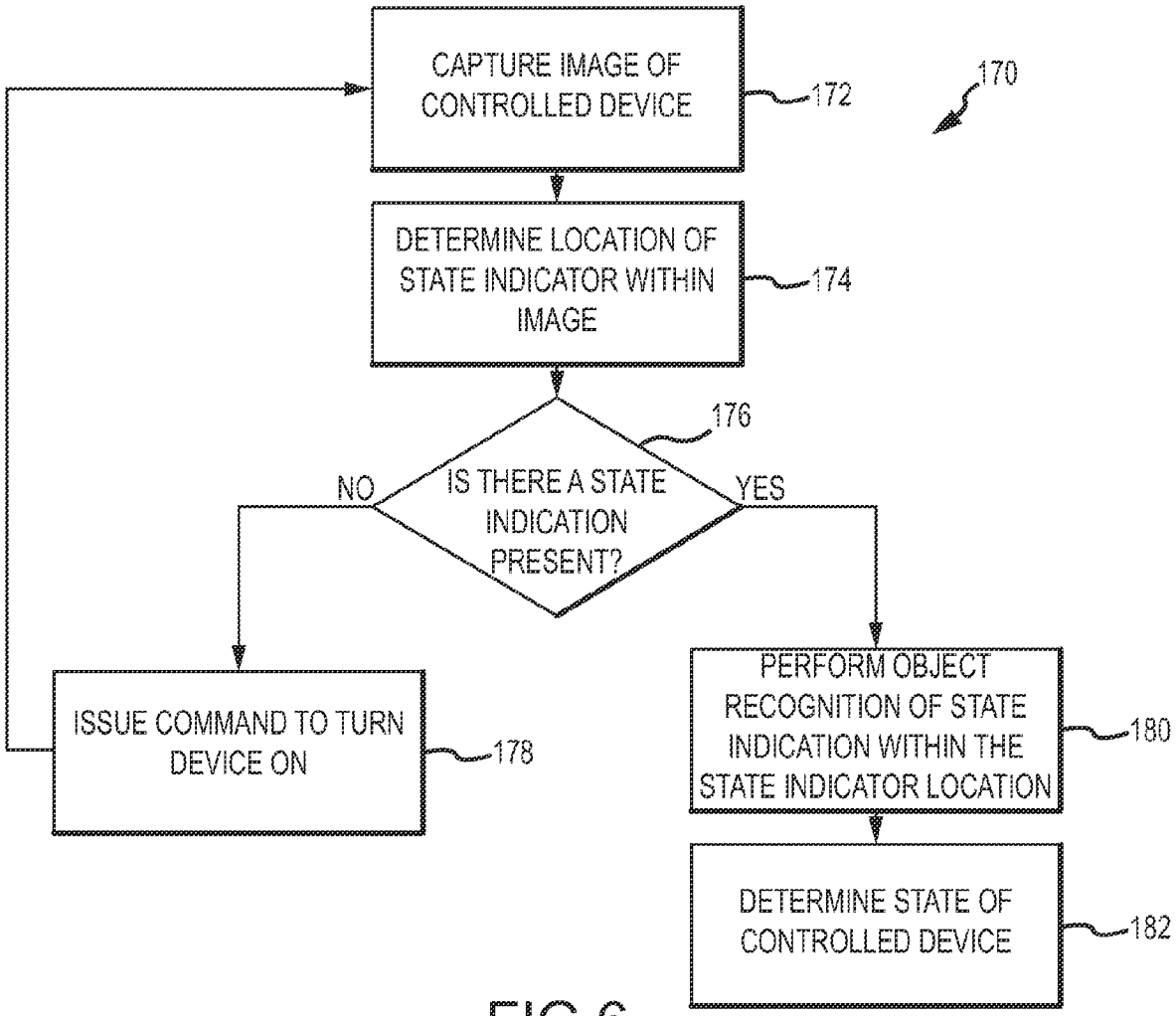
FIG. 6 is a flow chart illustrating a technique for operating the electronic device of FIG. 1 as a remote control in accordance with another example embodiment.

FIG. 6 is a flow chart illustrating another technique 170 for determining the state of a controlled device in accordance with another embodiment. In the technique 170, an image of the controlled device is captured (Block 172). The control device 100 may then determine the location of a state indicator for the device (Block 174). For example, the image may be evaluated to determine if there are any bright spots and, in particular, bright spots having a particular color (e.g., green or red). If it is determined that there is no state indication present (Block 176), the control device 100 may issue a command to turn on the controlled device and it is again determined if a status light is present. If a status indicator light is on, object recognition of the state indicator may be performed (Block 180). In particular, character recognition may be performed to determine the state of the device (Block 182).

In some embodiments, the technique 170 may be performed with respect to on screen information such as a display of the current channel and/or volume displayed on a television screen. In particular, the location of the status indicator on the screen may be determined and interpreted to determine the state of the device. In some embodiments, a channel indicator displayed during programming may be read from the screen by the controlling device 100 to determine the state (i.e., current channel) of a controlled device.

In some embodiments, the control device 100 may determine it is not prudent to change the state of the device to achieve a user's desired command. For example, in some cases, devices that are used together may become out of synch and the control device may determine that is the case and issue commands to bring the devices into synch. For example, a DVD player and a television may be used together to view a movie. In order to do so, both device are turned on. Some smart remotes are configured to issue "on" commands to turn both devices on simultaneously. However, is one of the devices is on when the command issues, they may remain out of synch and prevent a user from being able to view the movie. Accordingly, the determination of the state of a device may be used to determine whether it is prudent to issue a command or not.

Figure 7:
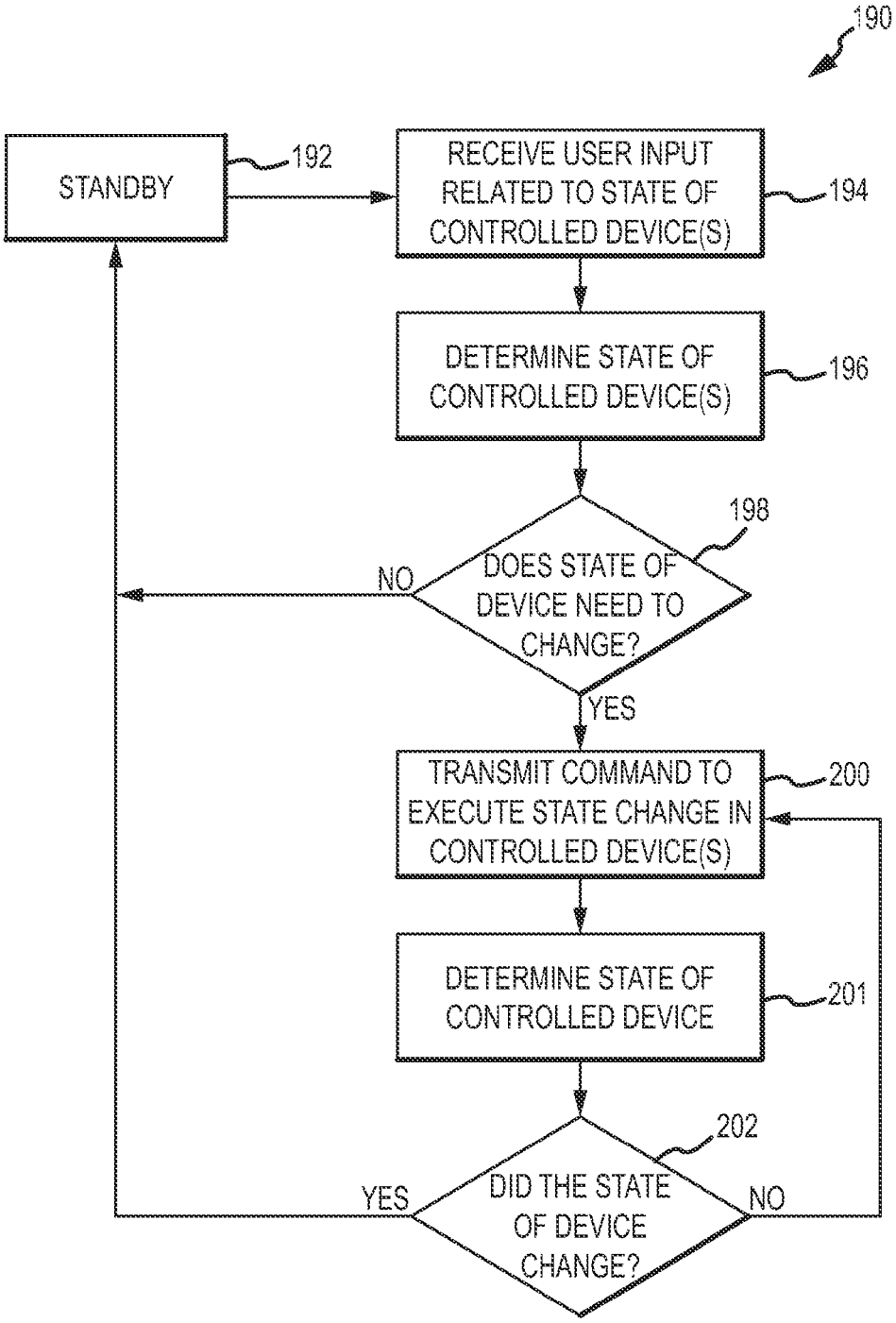
FIG. 7 is a flow chart illustrating an example technique for operating the control device to achieve a desired state in a controlled device.

FIG. 7 is a flow chart illustrating an example technique 190 for operating the control device 100 to achieve a desired state in a controlled device. Initially, the control device 100 may be in a standby state (Block 192). Upon receiving user input related to the state of the controlled device (Block 194), the control device 100 may determine the state of the controlled device (Block 196). The determination of the state of the controlled device may occur in accordance with any of the foregoing techniques or other techniques. Upon determining the state of the controlled device, the control device determines if the state of the controlled device should be changed (Block 198). The determination as to whether the state should change may depend on the particular context in which the user input the command. For example, if the user input a "Play" command and the television was already on but not the DVD player, no command to turn on the television should be transmitted. As such, as to the on/off command for the television, the control device may return to a standby state, whereas, as to the DVD player, the control device may transmit the command to execute the input instructions (e.g., turn on the DVD player and play the disc) (Block 200). The state of the controlled device is then determined again (Block 201) and it is determined if a state change occurred in the controlled device (e.g., did the DVD player turn on and start to play?) (Block 202). If not, the command is reissued by the control device 100 (Block 200). Upon successfully changing the state of the controlled device, the control device returns to standby 192. In some embodiments, the control device 100, upon determining that the state of the controlled device has not changed, may prompted a user to re-enter the command. This alternative embodiment, allows for user input that may be beneficial as the user may be able to detect a change in state when the control device in unable to. Additionally, in some embodiments, the control device 100 may request a user to re-aim or reposition the control device or controlled device so that it may better communication commands and/or so that it may better determine the state of the controlled device.

Figure 8:
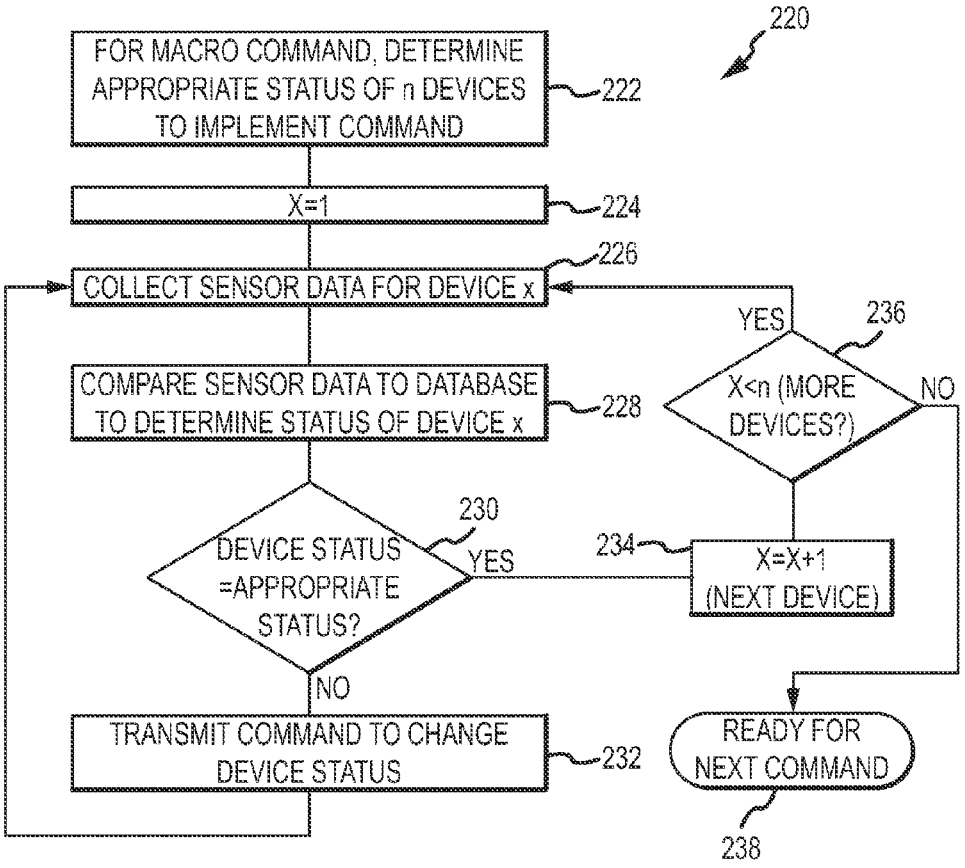
FIG. 8 is a flow chart illustrating execution of a macro command with state determination to control multiple controllable devices.

FIG. 8 is a flow chart illustrating an example technique 220 for executing a macro that may control multiple devices at once to achieve a desired result. For the purposes of the flow chart, "n" represents a number of devices controlled by the macro or for which the macro may issue a command and "x" indicates a number that corresponds to a device for which the macro is intended to issue control signals. The technique may include determining a status of the devices appropriate to implement a command (Block 222). For example, if the command is to watch a movie, each of the television and DVD player (and/or other devices such as a surround sound device) may have an appropriate status of "on" so that the movie may be watched. As used herein, "appropriate status" refers to the status of a device to properly execute a macro and achieve desired result. The "x" is set to "1" (Block 224) to refer to a first device and sensor data is collected for the first device (Block 226) in accordance with one or more of the techniques discussed in greater detail above. The collected sensor data may be compared to data stored in a database to determine the status of the first device (Block 228). The control device then determines if the first device is in a status appropriate for the macro (Block 230). If the first device is not in its appropriate status, the control device may issue a command to change the status of the controlled device (Block 232) and again collect sensor data (Block 226), determine the status of the device (Block 228) and if the status of the device is the appropriate status (Block 230).

If the device status is the appropriate status, the "x" is incremented (Block 234) and it is determined if there are any more devices that are controlled by the macro (Block 236). If there are more devices, the process is repeated with respect to the additional devices. In particular, the sensor data for the next device is collected (Block 226), compared to sensor data from a database (Block 228), and it is determine if the device has an appropriate status (Block 230). If there are no more devices controlled by the macro, the control device is ready for a next command (Block 238).

The foregoing describes some example embodiments to achieve closed-loop remote control functionality. Although the foregoing discussion has presented specific embodiments, persons skilled in the art will recognize that changes may be made in form and detail without departing from the spirit and scope of the embodiments. For example, in some embodiments, the control device 100 may be configured to store status information of controlled devices while the control device is operating as a remote control. In other embodiments, the control device 100 may periodically poll the controlled devices to determine the status of the devices. Moreover, other modes of communicating a state of a controlled device may be implemented. For example, in some embodiments, a network or Internet connection may be used to determine if Internet-enabled controlled devices are activated and/or what state they are in. In some embodiments, antennas can detect magnetic flux changes due to activation of inductive component within the controlled device (i.e., amplifier or transformers). Accordingly, the specific embodiments described herein should be understood as examples and not limiting the scope of the disclosure.

The invention claimed is:

1. A remote control operable to sequentially transmit instructions to each individual electronic device of a plurality of electronic devices in a closed loop, the remote control comprising:

a processor;

an input device configured to receive a user input command; and one or more sensors configured to collect sensor data that includes information related to a current state of each individual electronic device; wherein the processor is configured to execute the user input command by:

determining the current state of a first of the plurality of electronic devices based on first sensor data and independent of any digital state-identifying or device-identifying information electronically transmitted by any electronic device of or in communication with the plurality of electronic devices;

comparing the current state of the first electronic device to a desired state of the first electronic device based on the user input command;

upon determining that the current state of the first electronic device is different from the desired state of the first electronic device, wirelessly transmitting an instruction to the first electronic device to cause the first electronic device to enter the desired state;

obtaining first additional sensor data;

comparing the first additional sensor data to the first sensor data to verify that the current state of the first electronic device has changed to the desired state of the first electronic device;

determining the current state of a second of the plurality of electronic devices based on second sensor data and independent of any digital state-identifying or device-identifying information electronically transmitted by any electronic device of or in communication with the plurality of electronic devices;

comparing the current state of the second electronic device to a desired state of the second electronic device based on the user input command;

upon determining that the current state of the second electronic device is different from the desired state of the second electronic device, wirelessly transmitting an instruction to the second electronic device to cause the second electronic device to enter the desired state;

obtaining second additional sensor data; and comparing the second additional sensor data to the second sensor data to verify that the current state of the second electronic device has changed to the desired state of the second electronic device.

2. The remote control of claim 1 wherein the one or more sensors comprises a camera and the first sensor data is an image of at least one electronic device of the plurality of electronic devices.

3. The remote control of claim 1 wherein the one or more sensors comprises a microphone and the first sensor data is sound collected by the microphone.

4. The remote control of claim 2 wherein the processor is further configured to analyze the image to determine the color of one or more status indicator lights.

5. The remote control of claim 2 wherein the processor is further configured to analyze the image to determine if light is emanating from the first electronic device.

6. The remote control of claim 2 wherein the processor is further configured to:

determine if characters are present in the image;

recognize the characters; and determine the current state of the first electronic device based on the recognized characters.

7. The remote control of claim 2 wherein the processor is further configured to:

determine a presence of an on-screen status indicator;

recognize the presence of the on screen indicator as indicating a state change of the first electronic device; and determine the current state of the first electronic device.

8. A method of operating a remote control to set a current state of each electronic device of a plurality of electronic devices in a closed loop manner, the method comprising:

receiving a user input command corresponding to at least a first desired state corresponding to a first electronic device and a second desired state corresponding to a second electronic device of the plurality of electronic devices;

obtaining sensor data from one or more sensors;

for each individual electronic device of the plurality of electronic devices:

determining a current state of the first electronic device, based on the sensor data, and independent of any digital state-identifying or device-identifying information electronically transmitted by any electronic device of or in communication with the plurality of electronic devices;

transmitting a first command to change the current state of the first electronic device upon determining that the current state of the first electronic device is not the first desired state;

after transmitting the first command, determining the current state of the first electronic device using the sensor data;

determining whether the current state of the first electronic device changed in response to the transmitted first command; and upon determining that the current state of the first electronic device is not the first desired state, re-transmitting the command;

determining a current state of the second electronic device, based on the sensor data, and independent of any digital state-identifying or device-identifying information electronically transmitted by any electronic device of or in communication with the plurality of electronic devices;

transmitting a second command to change the current state of the second electronic device upon determining that the current state of the second electronic device is not the second desired state;

after transmitting the second command, determining the current state of the second electronic device using the sensor data;

determining whether the current state of the second electronic device changed in response to the transmitted second command; and upon determining that the current state of the second electronic device is not the second desired state, re-transmitting the command.

9. The remote control of claim 3 wherein the processor is further configured to analyze the sound collected by the microphone to determine if the current state of the first electronic device has changed.

10. The remote control of claim 1, wherein:

the desired state of the first electronic device is a power state; and the desired state of the second electronic device is a setting state.

11. A method of operating a remote control to set a current state of each electronic device of a plurality of electronic devices in a closed loop manner, the method comprising:

receiving a user input command corresponding to at least a first desired state corresponding to a first electronic device and a second desired state corresponding to a second electronic device of the plurality of electronic devices;

obtaining sensor data from one or more sensors;

determining a current state of the first electronic device, based on the sensor data, and independent of any digital state-identifying or device-identifying information electronically transmitted by any electronic device of the plurality of electronic devices;

transmitting a first command to change the current state of the first electronic device upon determining that the current state of the first electronic device is not the first desired state;

after transmitting the first command, determining the current state of the first electronic device using the sensor data;

determining whether the current state of the first electronic device changed in response to the transmitted first command; and upon determining that the current state of the first electronic device is not the first desired state, re-transmitting the command;

determining a current state of the second electronic device, based on the sensor data, and independent of any digital state-identifying or device-identifying information electronically transmitted by any electronic device of the plurality of electronic devices;

transmitting a second command to change the current state of the second electronic device upon determining that the current state of the second electronic device is not the second desired state;

after transmitting the second command, determining the current state of the second electronic device using the sensor data;

determining whether the current state of the second electronic device changed in response to the transmitted second command; and upon determining that the current state of the second electronic device is not the second desired state, re-transmitting the command.

12. The method of claim 11 wherein determining the current state of the first electronic device comprises capturing an image with a camera.

13. The method of claim 11 wherein determining the current state of the first electronic device comprises recording sound with a microphone.

14. The method of claim 12 wherein determining the current state of the first electronic device comprises determining a color of status indicator lights.

15. The method of claim 12 wherein determining the current state of the first electronic device comprises:

determining the presence of characters on the first electronic device; and recognizing the characters as indicative of an operative state of the first electronic device.

16. The method of claim 12 wherein discerning whether the current state of the first electronic device changed comprises determining if an on-screen status indicator was displayed.

17. A method of operating a remote control comprising:

receiving a user input command to set and/or verify a current state of each of a plurality of electronic devices to a desired state of each of the plurality of electronic devices;

determining the current state of a first electronic device of the plurality of electronic devices independently of any digital state-identifying or device-identifying information electronically transmitted by the first electronic device or any device in communication with the first electronic device to the remote control;

determining if the current state of the first electronic device should change to match the desired state of the first electronic device, the desired state associated with the user input command;

determining the current state of a second electronic device of the plurality of electronic devices independently of any digital state-identifying or device-identifying information electronically transmitted by the second electronic device or any device in communication with the second electronic device to the remote control;

determining if the current state of the second electronic device should change to match the desired state of the second electronic device, the desired state associated with the user input command;

sending a command to change the current state of the first electronic device and/or the second electronic device if it is determined that the current state of the first electronic device and/or the second electronic device should change respectively; and entering a remote control standby state if it is determined that the current state of the first electronic device and the second electronic device should not change.

18. The method of claim 17 wherein determining the current state of the first electronic device comprises at least one of capturing an image using a camera of the remote control and capturing sound using a microphone of the remote control.

19. The method of claim 18 wherein determining if the current state of the first electronic device should change comprises determining if the first electronic device is on, if the desired state requires the first electronic device to be operating.

20. The method of claim 17 further comprising: transmitting an instruction to change the current state of the first electronic device; and determining if the current state of the first electronic device changed in response to the transmitted command.

* * * * *